US007260227B2

(12) United States Patent
Higashihara et al.

(10) Patent No.: US 7,260,227 B2
(45) Date of Patent: Aug. 21, 2007

(54) METHOD AND DEVICE FOR MEASURING SOUND WAVE PROPAGATION TIME BETWEEN LOUDSPEAKER AND MICROPHONE

(75) Inventors: Daisuke Higashihara, Hyogo (JP); Shokichiro Hino, Tokyo (JP); Koichi Tsuchiya, Tokyo (JP); Tomohiko Endo, Tokyo (JP)

(73) Assignees: Etani Electronics Co., Ltd., Tokyo (JP); TOA Corporation, Hyogo (JP)

( * ) Notice: Subject to any disclaimer, the term of this patent is extended or adjusted under 35 U.S.C. 154(b) by 0 days.

(21) Appl. No.: 10/537,981

(22) PCT Filed: Dec. 9, 2003

(86) PCT No.: PCT/JP03/15702

§ 371 (c)(1),
(2), (4) Date: Nov. 18, 2005

(87) PCT Pub. No.: WO2004/054319

PCT Pub. Date: Jun. 24, 2004

(65) Prior Publication Data

US 2006/0140414 A1 Jun. 29, 2006

(30) Foreign Application Priority Data

Dec. 9, 2002 (JP) ..... 2002-357095

(51) Int. Cl.
*H04R 29/00* (2006.01)

(52) U.S. Cl. ..... 381/56

(58) Field of Classification Search ..... 381/56, 381/58; 379/406.01, 388.01, 388.07, 390.02; 370/286

See application file for complete search history.

(56) References Cited

U.S. PATENT DOCUMENTS

| | | | | |
|---|---|---|---|---|
| 4,541,279 | A | 9/1985 | Schomberg | |
| 6,774,934 | B1 * | 8/2004 | Belt et al. | 348/211.1 |
| 2005/0216211 | A1 * | 9/2005 | Nagatani | 702/56 |

FOREIGN PATENT DOCUMENTS

| | | |
|---|---|---|
| JP | 59-102127 | 6/1984 |
| JP | 07-095684 | 4/1995 |
| JP | 08-248077 | 9/1996 |
| JP | 11-340764 | 12/1999 |
| JP | 2000-097763 | 4/2000 |
| JP | 2000-099066 | 4/2000 |
| JP | 2001-112100 | 4/2001 |

OTHER PUBLICATIONS

International Application No. PCT/JP03/15702 *International Search Report* dated Feb. 27, 2004 by the Japanese Patent Office.

* cited by examiner

*Primary Examiner*—Brian T. Pendleton
(74) *Attorney, Agent, or Firm*—Marshall, Gerstein & Borun LLP

(57) ABSTRACT

A device 1 for measuring a propagation time of a sound wave comprises a sound source means 11 and a calculation means 12. The sound source means 11 outputs a time stretched pulse as a sound source signal input to a speaker 3. The calculation means 12 calculates a cross-correlation function of the time stretched pulse and the sound signal which is output from the speaker 3 and is received in a microphone 4. Based on the cross-correlation function, the propagation time of the sound wave between the speaker 3 and the microphone 4 is found.

8 Claims, 2 Drawing Sheets

METHOD AND DEVICE FOR MEASURING SOUND WAVE PROPAGATION TIME BETWEEN LOUDSPEAKER AND MICROPHONE

The present application claims the benefit of priority of International Patent Application No. PCT/JP2003/015702 filed on Dec. 9, 2003, which application claims priority of Japanese Patent Application No. 2002-357095 filed Dec. 9, 2002. The entire text of the priority application is incorporated herein by reference in its entirety.

TECHNICAL FIELD

The present invention relates to a method and device for measuring a propagation time of a sound wave between a speaker and a microphone.

BACKGROUND ART

In some cases, it is necessary to measure a propagation time of a sound wave from a speaker to a microphone in a space in which an acoustic system is installed. This corresponds to, for example, cases where a frequency characteristic of the acoustic system is measured at a listening position, and a signal having a frequency characteristic that varies with time is used as a sound source signal for measurement. In such cases, measurement with higher precision is sometimes achieved by taking in a signal from the microphone installed at the listening position after passing the signal through a filter that varies its frequency characteristic according to a time variation in the frequency characteristic of the sound source signal for measurement, rather than by directly taking in the signal from the microphone installed at the listening position. In this case, it becomes necessary to delay the variation in the frequency characteristic of the filter by time for which the sound wave propagates over a distance from the speaker to the listening position, instead of simultaneously progressing the variation in the frequency characteristic of the sound source signal for measurement and the variation in the frequency characteristic of the filter. For this purpose, it is necessary to measure the propagation time of the sound wave from the speaker to the microphone installed at the listening position.

Accordingly, there has been conventionally proposed a method of measuring a propagation time of a sound wave between a speaker and a microphone using a pulse (see for example, Japanese Laid-Open Patent Application Publication No. 2001-112100 (see page 3, FIGS. 1 and 2)). Specifically, a propagation time of a pulse sound which is output from the speaker and arrives at the microphone is measured.

Measurement using the pulse sound can be conducted with relatively higher precision unless it is affected by a noise. However, since the pulse sound has a small energy with respect to its amplitude, it is difficult for the microphone to receive the sound with a preferred S/N ratio. In this method, therefore, accurate measurement is not always conducted.

In order to improve this method, the applicant has made an attempt to measure a propagation time of a sound wave having a sweep signal as a sound source, as a signal having a relatively large energy with respect to its amplitude. Specifically, the sweep signal which is frequency-swept in a short time is input to a speaker, which outputs a sweep sound, which is received by a microphone. And, arrival time of the sound wave is measured for each frequency band.

If the sweep signal as the sound source signal is known, it is possible to know when a component in each frequency band is output from the speaker. In addition, it is possible to know arrival time of the component in each frequency band by band pass filtering the signal received by the microphone.

By finding an effective value of the signal in each frequency band received by the microphone for a fixed duration while slightly shifting a time starting point, a root-means square (RMS) value as a function of the time starting point may be found, and a time point at which the RMS value becomes maximum may be assumed to be the arrival time of the component in each frequency band. This enables more accurate measurement of a distance.

This method has advantages as follows: ① A frequency band with a higher level can be selected because of the use of a plurality of frequency bands. ② Interference from a noise is less because of the use of the band pass filter. ③ The sweep signal is resistant to a noise because it has an energy larger than that of the pulse.

On the other hand, this method has disadvantages as described below. The response is slow because of the use of the band pass filter. A measurement value may be corrected in view of a known delay of a response time. But, if the response time of the band pass filter is larger than the propagation time of the sound wave between the speaker and the microphone, measurement precision is not ensured. While the signal is less affected by the noise as the frequency band of the band pass filter decreases, the response time of the band pass filter increases.

The response time of the band pass filter decreases as the frequency band of the band pass filter increases, but the signal is susceptible to the noise. Further, a frequency characteristic of an acoustic system in that frequency range may appear, which may cause a peak value of the signal in a frequency other than a target frequency to be detected. This may lead to inaccurate measurement.

DISCLOSURE OF THE INVENTION

The present invention has been made in view of the above mentioned problems, and an object of the present invention is to provide a method and device for measuring a propagation time of a sound wave, which is less susceptible to a noise or a delay time of equipment and is hence capable of accurate measurement.

In order to solve the above mentioned problems, a method of measuring a propagation time of a sound wave between a speaker and a microphone, according to the present invention, comprises: a first step of outputting a time stretched pulse from the speaker; a second step of receiving a sound signal output from the speaker in the microphone and taking in the received sound signal from the microphone; and a third step of calculating a cross-correlation function of the time stretched pulse and the received sound signal taken in in the second step, wherein the propagation time of the sound wave between the speaker and the microphone is found based on the cross-correlation function. In addition, in order to solve the above mentioned problems, a device for measuring a propagation time of a sound wave between a speaker and a microphone, according to the present invention, comprises: a sound source means; and a calculation means, wherein the sound source means is configured to output a time stretched pulse as a sound source signal input to the speaker, and the calculation means is configured to take in, from the microphone, a sound signal which is output from the speaker and is received in the microphone, and to calculate a cross-correlation function of the time stretched pulse and the received sound signal taken in, and to find the propagation time of the sound wave between the speaker and the microphone based on the cross-correlation function.

In accordance with such a method and device, the time stretched pulse is used as the sound source signal. The time stretched pulse is less susceptible to a noise because of its relatively large energy with respect to its amplitude. Therefore, a measurement value of the propagation time of the sound wave by the above method and device has high reliability. Also, it is known that the cross-correlation function of the time stretched impulse and the response waveform to which the time stretched pulse is input conforms to an impulse response in that system. As a result, measurement is conducted with precision substantially as high as that with which measurement is conducted using the impulse.

In the method of measuring a propagation time of a sound wave between a speaker and a microphone may further comprise a fourth step of detecting a time when the cross-correlation function has a maximum value, a time when the cross-correlation function has a minimum value, or a time when the cross-correlation function has a maximum absolute value. In the device for measuring a propagation time of a sound wave between a speaker and a microphone, the calculation means may be configured to detect a time when the cross-correlation function has a maximum value, a time when the cross-correlation function has a minimum value, or a time when the cross-correlation function has a maximum absolute value.

In the method of measuring a propagation time of a sound wave between a speaker and a microphone, the first step, the second step, and the third step may be performed plural times, and the method may further comprise: a fifth step of synchronizing and adding a plurality of cross-correlation functions obtained in the third step performed plural times, wherein the propagation time of the sound wave between the speaker and the microphone may be found based on the cross-correlation function obtained by synchronizing and adding the plurality of cross-correlation functions. In the device for measuring a propagation time of a sound wave between a speaker and a microphone, the sound source means may be configured to output the time stretched pulse plural times, and the calculation means may be configured to calculate the cross-correlation function for each time stretched pulse output from the sound source means, to synchronize and add cross-correlation functions, and to find the propagation time of the sound wave between the speaker and the microphone based on the cross-correlation function obtained by synchronization and addition.

In accordance with such a method and device, the synchronization and addition enable measurement with high reliability.

The above and further objects and features of the invention will be more fully be apparent from the following detailed description with the accompanying drawings.

BEST MODE FOR CARRYING OUT THE INVENTION

An embodiment of the present invention will be described with reference to the drawings.

Figure 1:
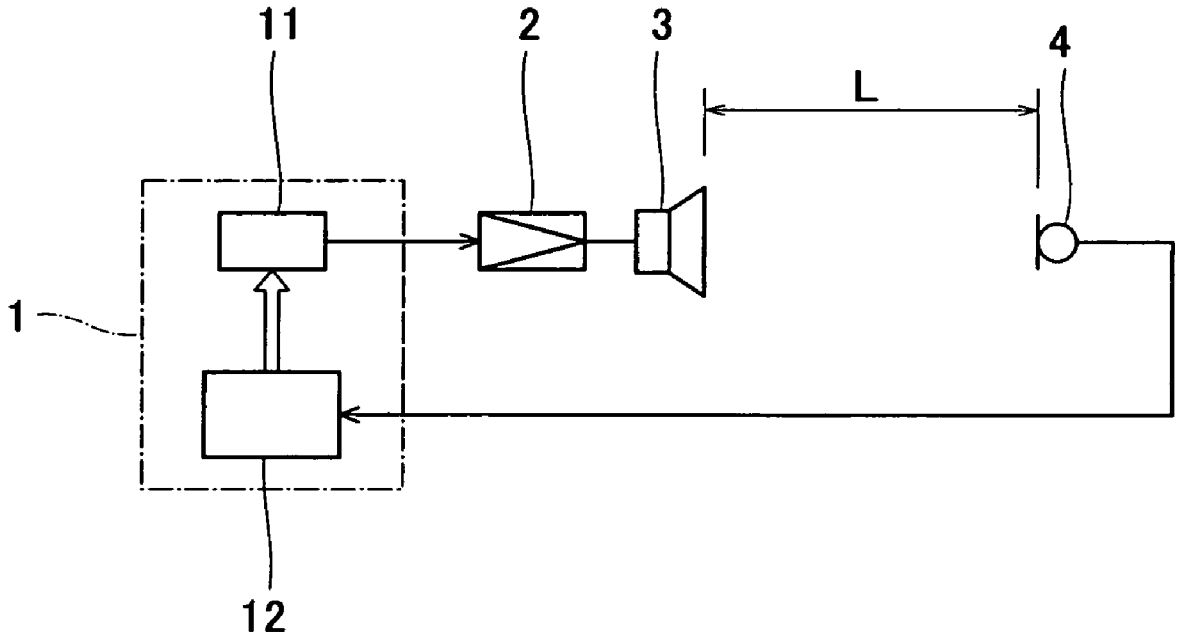
FIG. 1 is a view schematically showing a construction of a device for measuring a propagation time of a sound wave and an acoustic system.

FIG. 1 is a view schematically showing a construction of an embodiment of a device according to the present invention and an acoustic system to be measured. A device (device for measuring a propagation time of a sound wave between a speaker and a microphone) 1 of FIG. 1 is capable of carrying out an embodiment of a method of the present invention (method of measuring a propagation time of a sound wave between a speaker and a microphone).

The device 1 comprises a DSP (digital signal processor), an A/D converter, a D/A converter, and the like. In FIG. 1, the device 1 is illustrated as including a sound source portion 11 and a calculation and control portion 12, giving attention to main function of the device 1.

The device 1 is configured to measure a propagation time of a sound wave between a speaker 3 and a microphone 4. An amplifier 2 and the speaker 3 form a part of an acoustic system installed in an acoustic space (e.g., music hall, gymnastic hall, or playing field). The microphone 4 is installed at a listening position (e.g., position of seat on which audience sits) in this acoustic space. As the microphone 4, a noise meter may be used. The microphone 4 is located to be spaced a distance L apart from the speaker 3. The distance L is unknown, but can be calculated if the propagation time of the sound wave between the speaker 3 and the microphone 4 can be measured.

A sound source signal is output from the sound source portion 11 to the amplifier 2. The amplifier 2 power-amplifies the signal and outputs the amplified signal to the speaker 3, which radiates the signal as amplified sound. The microphone 4 receives the amplified sound output from the speaker 3. The microphone 4 outputs a signal to the calculation and control portion 12.

The calculation and control portion 12 is configured to control the sound source portion 11. More specifically, the sound source portion 11 receives a command signal from the calculation and control portion 12 and outputs a time stretched pulse (hereinafter simply referred to as "TSP") as a sound source signal. The TSP refers to a signal which is stretched in a time axis direction by varying a phase of an impulse in proportion to a square of a frequency.

Figure 2:
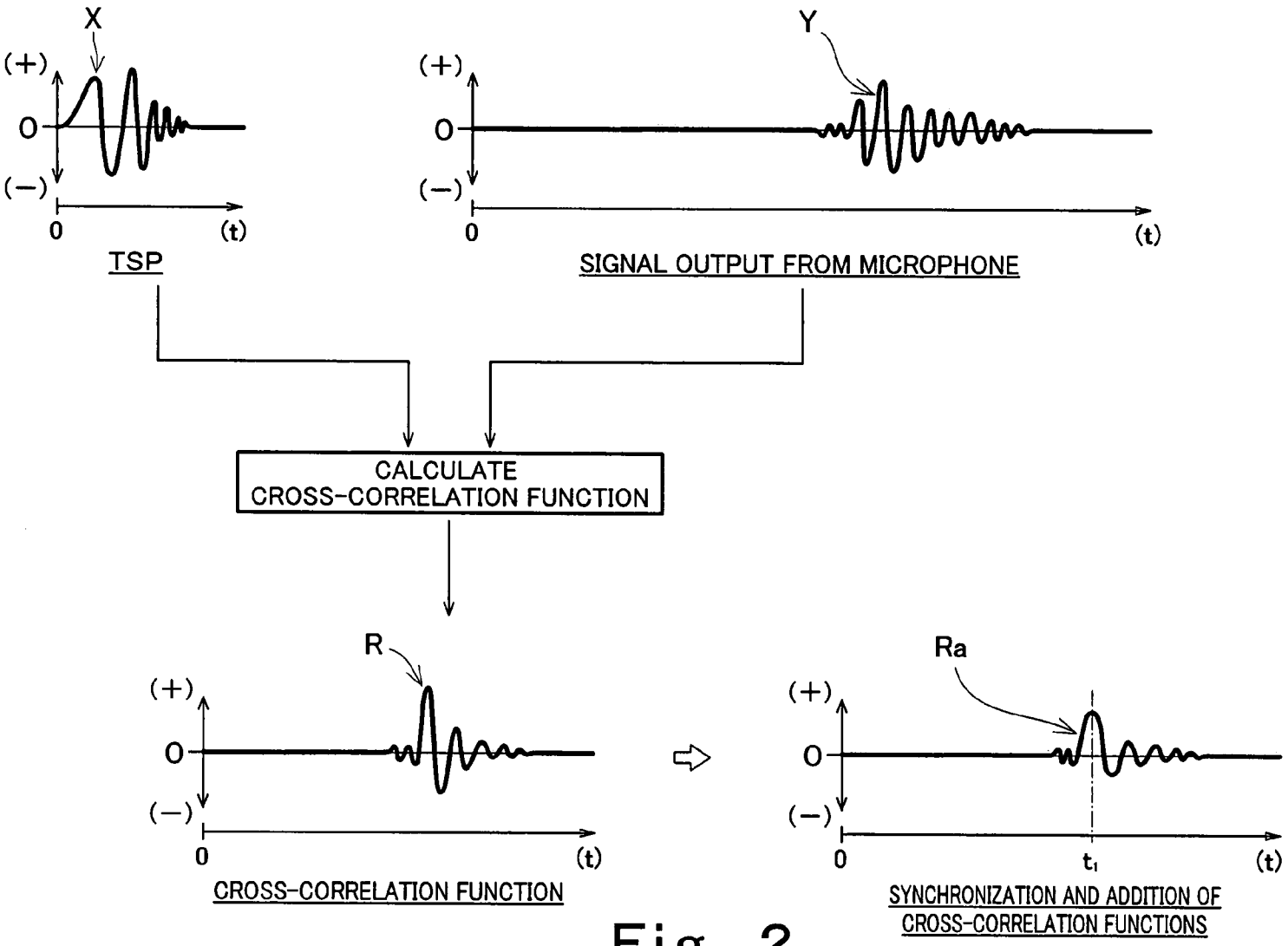
FIG. 2 is a view schematically showing a calculation content of a calculation and control portion.

FIG. 2 is a view schematically showing a calculation content of the calculation and control portion 12.

The calculation and control portion 12 pre-stores a waveform of the TSP and causes the sound source portion 11 to output the TSP. In FIG. 2, the waveform of the TSP is represented by X. The TSP is stored as 128 sample data in the calculation and control portion 12. Sampling frequency of the TSP is 48 kHz, and therefore, duration of the TSP is about 2.7 m second. The TSP has an even amplitude characteristic up to 5 kHz.

The calculation and control portion 12 outputs data of the TSP to the sound source portion 11, and outputs the command signal to the sound source portion 11 to cause the sound source portion 11 to output the TSP. At the same time, the calculation and control portion 12 starts sampling of the signal (signal indicated by Y in FIG. 2) output from the microphone 4. Sampling frequency is 48 kHz and sampling period is 0.5 second.

After an elapse of time ts after the calculation and control portion 12 has output the command signal to cause the sound source portion 11 to output the TSP, the sound source portion 11 outputs the TSP. In other words, after the elapse of the time ts after the calculation and control portion 12 has started sampling of the signal output from the microphone 4, the sound source portion 11 outputs the TSP. This delay time ts occurs due to the A/D converter and the D/A converter included in the sound source portion 11, and is recognized (stored) in the calculation and control portion 12. Hereinafter, this time ts is referred to as "sound source output delay time ts."

The calculation and control portion 12 calculates a cross-correlation function of the waveform of the TSP pre-stored therein and the signal waveform which has been output from the microphone 4 and sampled.

The following formula (formula 1) is a calculation formula of the cross-correlation function.

$$R_{(m)} = \frac{1}{N\delta_X\delta_Y}\sum_{n=0}^{N-1} X_{(n)} \cdot Y_{(n+m)} \quad \text{(formula 1)}$$

In the above formula (formula 1), N is the number of times sampling is performed, and δX and δY are standard deviations in X(n) and Y(n), respectively.

In FIG. 2, R represents the cross-correlation function obtained by calculation according to the above formula (formula 1).

The calculation of the cross-correlation function may be performed after the signal output from the microphone 4 has been sampled for 0.5 second and all the data corresponding to 0.5 second have been sampled, or otherwise, may be performed for each sampling using 128 sample data sampled most recently while sampling the signal output from the microphone 4. This is because, the calculation of the cross-correlation function can be started when at least 128 sample data of the signal output from the microphone 4 has been stored, since the TSP output from the sound source portion 11 is 128 samples.

When the TSP is input to a system and a response waveform thereof is obtained, the cross-correlation function of the TSP and the response waveform thereof conforms to an impulse response of the system. Therefore, it may be assumed that the calculation and control portion 12 calculates the impulse response of the system.

The cross-correlation function R may be found only for one TSP output from the sound source portion 11. Nonetheless, precision improves if the cross-correlation functions R are found for respective of the TSPs output plural times (several times), and are synchronized and added. In FIG. 2, Ra represents a cross-correlation function obtained by synchronizing and adding, and averaging the cross-reference functions R output plural times.

The calculation and control portion 12 detects a time when the waveform of the cross-correlation function Ra obtained by synchronization and addition has a maximum value. The waveform of the cross-correlation function Ra of FIG. 2 has the maximum value at time t1. This time t1 may be assumed as the delay time in the whole system of FIG. 1. Hereinafter, the time t1 when the cross-correlation function has the maximum value is referred to as "total delay time t1."

The total delay time t1 includes the above mentioned sound source output delay time ts and time tb (hereinafter referred to as "spatial delay time tb") for which the sound wave propagates through a space ranging from the speaker 3 to the microphone 4. It shall be appreciated that a delay time elapsed from when the signal is input to the amplifier 2 until when the signal vibrates a diaphragm of the speaker 3 or a delay time elapsed from when a diaphragm of the microphone 4 starts vibrating until when the signal caused by the vibration appears at an output terminal of the microphone 4 is negligible small in contrast to the spatial delay time tb. When the spatial delay time tb is measured for adjustment or measurement of the acoustic system including the amplifier 2 and the speaker 3, it is convenient to include, in the spatial delay time tb, the delay time elapsed from when the signal is input to the amplifier 2 until when the signal vibrates the diaphragm of the speaker 3.

As described above, since the calculation and control portion 12 pre-stores the sound source output delay time ts, the spatial delay time tb can be calculated by detecting the total delay time t1. According to a procedure shown in FIG. 2, synchronization and addition are performed to obtain the cross-correlation function Ra, the time t1 when the cross-correlation function Ra has the maximum value is detected, and the spatial delay time tb is obtained by subtracting the sound source output delay time ts from the total delay time t1. This is represented by a formula: "tb=t1−ts." The spatial delay time tb is multiplied by a sound speed c to obtain a distance between a point where the speaker 3 is installed and a point where the microphone 4 is installed.

If the sound source output delay time ts is negligible small in contrast to the spatial delay time tb, then the total delay time t1 may be assumed to be the spatial delay time tb. If the calculation and control portion 12 starts sampling the signal output from the microphone 4 at the same time the sound source portion 11 starts outputting the TSP, the sound source delay time ts may be assumed to be 0.

As described previously, when the TSP is input to a system and a response waveform thereof is obtained, the cross-correlation function of the TSP and the response waveform thereof conforms to the impulse response in that system, and therefore, it may be assumed that the calculation and control portion 12 calculates the impulse response in that system. Therefore, the device 1 for measuring the propagation time of the sound wave shown in FIG. 1 is capable of measuring the propagation time of the sound wave between the speaker 3 and the microphone 4 with precision substantially as high as that with which measurement is conducted using the impulse. In addition, since the energy of the sound source signal is less susceptible to the noise because of its relatively large energy, the propagation time of the sound wave between the speaker 3 and the microphone 4 can be measured with high precision.

Thus far, one embodiment of the present invention has been described. While in the above embodiment, the cross-correlation function is calculated according to the formula (1), it may alternatively be calculated according to a formula (2) in which a calculation portion ((1/N ·δX·δY) portion) for normalization in the formula (1) is omitted.

$$R_{(m)} = \sum_{n=0}^{N-1} X_{(n)} \cdot Y_{(n+m)} \quad \text{(formula 2)}$$

While in the above embodiment, the time when the cross-correlation function obtained by synchronization and addition (or by averaging of cross-correlation functions) has the maximum value is detected as the total delay time, a time when a cross-correlation function found for only one TSP output from the sound source portion 11 has the maximum value may alternatively be detected as the total delay time, without synchronization and addition.

While in the above embodiment, the time when the cross-correlation function has the maximum value is detected to find the time when the peak appears on a plus side of the cross-correlation function and is assumed as the total delay time, a time when the cross-correlation function has a minimum value may be detected to find a time when the peak appears on a minus side and may be assumed as the total delay time. Further, a time when the cross-correlation function has a maximum absolute value may be detected and may be assumed as the total delay time.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

A method and device for measuring a propagation time of a sound wave between a speaker and a microphone of the present invention are advantageous in technical fields of acoustic systems, since the propagation time of the sound wave between the speaker and the microphone can be accurately measured.

The invention claimed is:

1. A method of measuring a propagation time of a sound wave between a speaker and a microphone, comprising:

a first step of outputting a time stretched pulse from the speaker;

a second step of receiving a sound signal output from the speaker in the microphone and taking in the received sound signal from the microphone; and a third step of calculating a cross-correlation function of the time stretched pulse and the received sound signal taken in the second step, wherein the propagation time of the sound wave between the speaker and the microphone is found based on the cross-correlation function.

2. The method of measuring a propagation time of a sound wave between a speaker and a microphone according to claim 1, further comprising:

a fourth step of detecting a time when the cross-correlation function has a maximum value, a time when the cross-correlation function has a minimum value, or a time when the cross-correlation function has a maximum absolute value.

3. The method of measuring a propagation time of a sound wave between a speaker and a microphone according to claim 1, wherein the first step, the second step, and the third step are performed plural times, the method further comprising:

a fifth step of synchronizing and adding a plurality of cross-correlation functions obtained in the third step performed plural times, wherein the propagation time of the sound wave between the speaker and the microphone is found based on the cross-correlation function obtained by synchronizing and adding the plurality of cross-correlation functions.

4. A device for measuring a propagation time of a sound wave between a speaker and a microphone, comprising:

a sound source means; and a calculation means, wherein the sound source means is configured to output a time stretched pulse as a sound source signal input to the speaker, and the calculation means is configured to take in, from the microphone, a sound signal which is output from the speaker and is received in the microphone, and to calculate a cross-correlation function of the time stretched pulse and the received sound signal taken in, and to find the propagation time of the sound wave between the speaker and the microphone, based on the cross-correlation function.

5. The device for measuring a propagation time of a sound wave between a speaker and a microphone, according to claim 4, wherein the calculation means is configured to detect a time when the cross-correlation function has a maximum value, a time when the cross-correlation function has a minimum value, or a time when the cross-correlation function has a maximum absolute value.

6. The device for measuring a propagation time of a sound wave between a speaker and a microphone, according to claim 4, wherein the sound source means is configured to output the time stretched pulse plural times, and the calculation means is configured to calculate the cross-correlation function for each time stretched pulse output from the sound source means, to synchronize and add cross-correlation functions, and to find the propagation time of the sound wave between the speaker and the microphone based on the cross-correlation function obtained by synchronization and addition.

7. The method of measuring a propagation time of a sound wave between a speaker and a microphone according to claim 2, wherein the first step, the second step, and the third step are performed plural times, the method further comprising:

a fifth step of synchronizing and adding a plurality of cross-correlation functions obtained in the third step performed plural times, wherein the propagation time of the sound wave between the speaker and the microphone is found based on the cross-correlation function obtained by synchronizing and adding the plurality of cross-correlation functions.

8. The device for measuring a propagation time of a sound wave between a speaker and a microphone, according to claim 5, wherein the sound source means is configured to output the time stretched pulse plural times, and the calculation means is configured to calculate the cross-correlation function for each time stretched pulse output from the sound source means, to synchronize and add cross-correlation functions, and to find the propagation time of the sound wave between the speaker and the microphone based on the cross-correlation function obtained by synchronization and addition.

* * * * *